United States Patent [19]

Winterhalter

[11] Patent Number: 4,535,695

[45] Date of Patent: Aug. 20, 1985

[54] FUSE FOR A SPIN-TYPE PROJECTILE

[75] Inventor: Walter Winterhalter, Tennenbronn, Fed. Rep. of Germany

[73] Assignee: Gebruder Junghans GmbH, Schramberg, Fed. Rep. of Germany

[21] Appl. No.: 555,485

[22] Filed: Nov. 28, 1983

[30] Foreign Application Priority Data

Dec. 2, 1982 [DE] Fed. Rep. of Germany ..... 3244529

[51] Int. Cl.[3] ..... F42C 15/22; F42C 15/26

[52] U.S. Cl. ..... 102/240; 102/238; 102/245

[58] Field of Search ..... 102/240, 237, 238, 239, 102/236, 244, 245, 231, 222

[56] References Cited

U.S. PATENT DOCUMENTS

| | | | |
|---|---|---|---|
| 3,033,115 | 5/1962 | Guerne | 102/240 |
| 3,270,670 | 9/1966 | Guerne | 102/240 |
| 3,479,955 | 11/1969 | Birkigt | 102/240 X |
| 3,489,089 | 1/1970 | Kaiser et al. | 102/240 |
| 3,734,023 | 5/1973 | Kaiser et al. | 102/238 |
| 3,994,230 | 11/1976 | Kalin | 102/240 X |
| 3,995,557 | 12/1976 | Engel et al. | 102/240 X |
| 4,406,225 | 9/1983 | Backstein et al. | 102/236 X |

FOREIGN PATENT DOCUMENTS

| | | | |
|---|---|---|---|
| 2405179 | 8/1975 | Fed. Rep. of Germany . | |
| 2918039 | 11/1980 | Fed. Rep. of Germany | 102/240 |

*Primary Examiner*—David H. Brown

*Attorney, Agent, or Firm*—Burns, Doane, Swecker & Mathis

[57] ABSTRACT

A fuse is used in a spin-type projectile. A percussion cap is mounted in a rotor which is normally disposed in a safety position. Rotation of the rotor to a firing position wherein the percussion cap is aligned with a firing pin is prevented by two independently operating safety devices prior to firing of the projectile. A first safety device comprises a conventional centrifugal mechanism which normally holds a bush within a recess of the rotor but releases same when the projectile spins. A second safety device comprises the firing pin which is urged into engagement with the rotor recess by a spring. An inertia disk is moved, in response to spinning of the projectile, to a position holding the firing pin out of engagement with the rotor recess. This enables the rotor to rotate to its firing position. When the projectile spin slows down or when the projectile impacts the target, the inertia disk can be moved aside as the firing pin enters the percussion cap.

10 Claims, 7 Drawing Figures

FUSE FOR A SPIN-TYPE PROJECTILE

BACKGROUND AND OBJECTS OF THE INVENTION

The invention concerns a fuse for a spinning projectile. The fuse has a self-decomposing device, a winding strip surrounding a centrifugal body and an axially mobile striking pin urged by centrifugal force into a percussion cap.

In known fuses for spinning projectiles, for example according to DE No. 24 05 179 and DE-OS No. 29 18 039, the fuse holder has a double safety. One safety device usually comprises a spring-mass system responding to translation, the operation whereof depends on a centrifugal body-winding strip system reacting to the spin. This provides adequate prebarrel safety. A second safety device for the fuse holder is in the form of a centrifugal body, which under the effect of the spin releases a bolt penetrating into the fuse holder and responding to translation.

Additionally to such safeties, the fuses possess a self-decomposing device. This comprises a plate upon which a lever-spring system is mounted. The levers move due to their masses (in the case of a high-spin effect) initially against a spring force; after a decreasing spin effect, the levers move with the spring force. A percussion bush is thereby released, which drives the firing pin for the self-decomposition of the projectile into the percussion cap of the fuse holder. The above-described safeties and the device for the self-decomposition of the projectile have proved their reliability in practical applications. However, in view of the number of parts used, the double safety of the fuse holder and particularly the self-decomposing device, is expensive. To simplify the configuration, therefore, the second, independent safety for the fuse can be eliminated, however, there thus occurs an appreciable safety hazard.

It is an object of the invention to provide a fuse for a spinning projectile with a self-decomposing device of the afore-mentioned type, wherein two independent safeties are retained and the number of parts is reduced without diminishing the necessary safety condition.

SUMMARY OF PREFERRED EMBODIMENTS OF THE INVENTION

According to the invention, this object is attained whereby the firing pin is arranged to be restrained axially by an inertia disk responding to the projectile spin. For this purpose, the firing pin may be provided with a conical surface remote from the a plurality of centrifugal bodies, followed axially by a cylindrical shoulder, which, together with the conical surface, is axially movable within a center bore of the inertia disk.

The invention therefore results in the spring-mass system (heretofore dependent in its functioning on the wound strip and responding to translation) being rendered operable partially independently of the wound strip. The latter comprises a known percussion bush compression spring. In the present invention, the release of the firing pin is achieved by an inertia disk responding to the spin. The firing pin is thus enabled to effect, on the one hand, a safety function, and on the other hand, the self-decomposing function. The safety device heretofore dependent of the wound strip is not affected and is preserved.

The bore in the inertia disk may be provided with a rounded or chamfered edge or bore transition which cooperates with the conical surface of the firing pin. In this manner, in case of an adequate spin effect on the inertia disk and its eccentric escape, the firing pin may be displaced axially by the abutting of the bore edge against the conical surface in a simple fashion, whereby the tip of the firing pin, together with the safety bush, is moved out of contact with the percussion cap.

The inertia disk may be set loosely in a bore of the housing, the diameter of which is larger than that of the diameter of the inertia disk by at least twice the amount corresponding to the difference between the largest and smallest radii of the conical surface.

When the fuse is employed as a base-type fuse, the shoulder of the firing pin projects, in its safety position, into the bore of the inertia disk. The retreat of the firing pin upon the firing of the projectile is thereby taken into consideration in a simple manner. The projection of the cylindrical shoulder into the bore in the safety position is obtained for example by an axial extension of the shoulder.

To compensate for an unbalance, the inertia disk may further be in the form of a slide, moving within a groove of a plate arranged above the centrifugal body. A compensation of an unbalance and a reduction in weight may be effected according to the invention by means of one or several recesses in the outer circumference of the inertia disk.

THE DRAWING

Examples of the invention are shown in the drawing, wherein.

DETAILED DESCRIPTION OF PREFERRED EMBODIMENTS OF THE INVENTION

Figure 1:
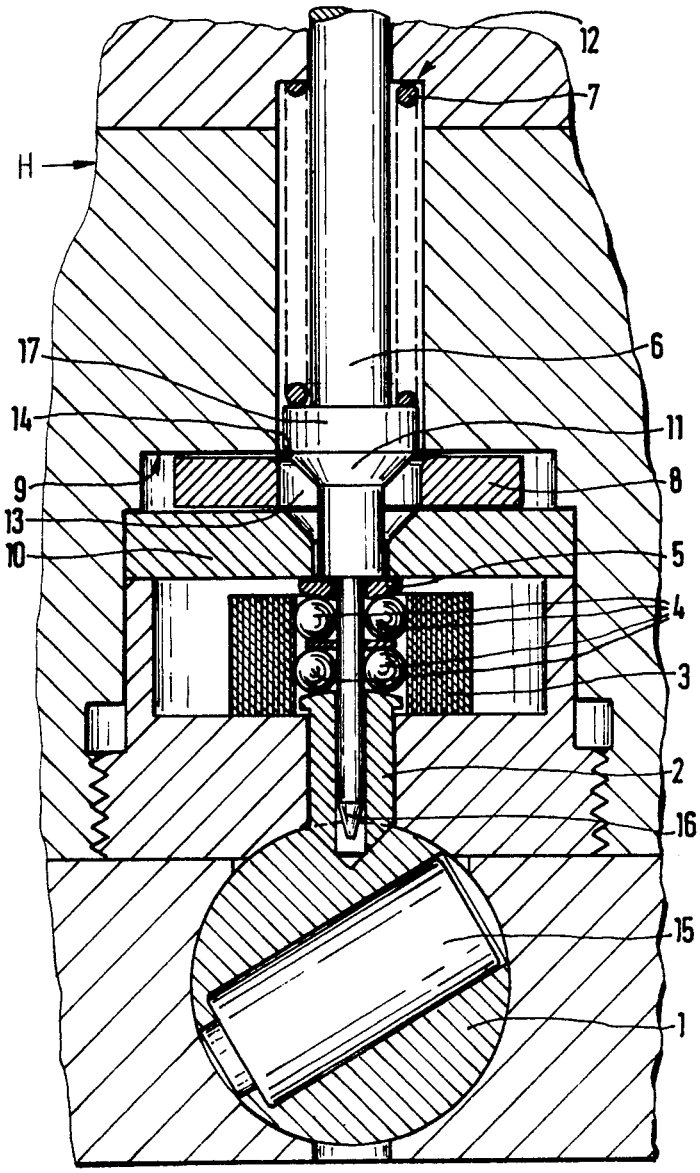
FIG. 1 is a longitudinal sectional view through a spinning projectile with a self-decomposing device in the safety position.

The fuse for spinning projectiles shown only partially in FIGS. 1–4 is a so-called nose fuse and comprises essentially (i) a rotor 1 serving as a fuse holder, (ii) a safety bush 2, (iii) a wound strip, 3 covering a centrifugally-responsive arrangement comprising bodies 4, and (iv) a pressure disk 5 resting axially on two of the centrifugal bodies 4. FIGS. 1–4 further show a firing pin 6, a firing pin spring 7 and an inertia disk 8, which according to FIG. 1 is arranged loosely in a bore 9 of the housing H and axially between the bore and a plate 10. The firing pin spring 7 forms, together with the firing pin 6, a spring-mass system. The tip 16 of the firing pin faces away from the front or nose of the projectile. The firing pin spring 7 is resting with one end on a part 12 of the housing while the other end is pressuring the firing pin 6 against the pressure disk 5. This pressure is transmitted by the centrifugal bodies 4 to the safety bush 2, which in turn, engages the rotor 1, thereby securing it.

The tip 16 of the firing pin 6 in this position enters a recess in the rotor 1 and represents an additional second safety for the rotor 1. The rotor 1 is in an unbalanced condition in the sense that when the projectile spins, the rotor wants to rotate in a manner bringing the percussion cap 15 into alignment with the firing pin 6. Of course, such rotation is normally prevented by the bush 2 and the tip 16 of the firing pin 6.

In the area of the inertia disk 8, the firing pin 6 has a conical surface 11, which is followed in the axial direction by a cylindrical shoulder 17. The center bore 13 of the inertia disk 8 includes an edge 14 disposed adjacent the conical surface 11 and which is blunted, e.g., is rounded or chamfered. The diameter of the central bore 13 is at least slightly larger than the diameter of the cylindrical shoulder 17. The diameter of the bore 9 of the housing is larger than the diameter of the inertia disk 8 by at least twice the amount of the difference between the largest and smallest radii of the conical surface 11.

Figure 2:
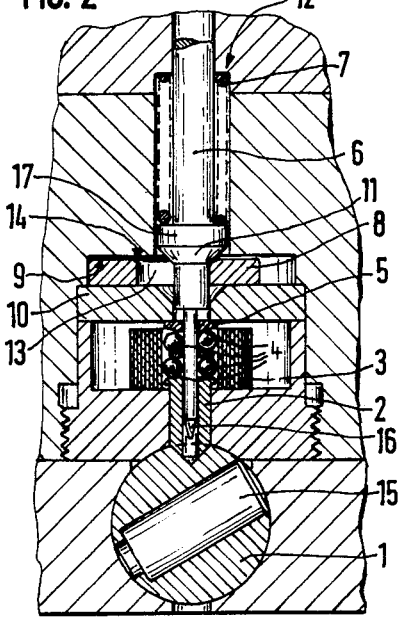
FIG. 2 shows the fuse for a spinning projectile similar to FIG. 1 shortly after the firing of the projectile.
Figure 3:
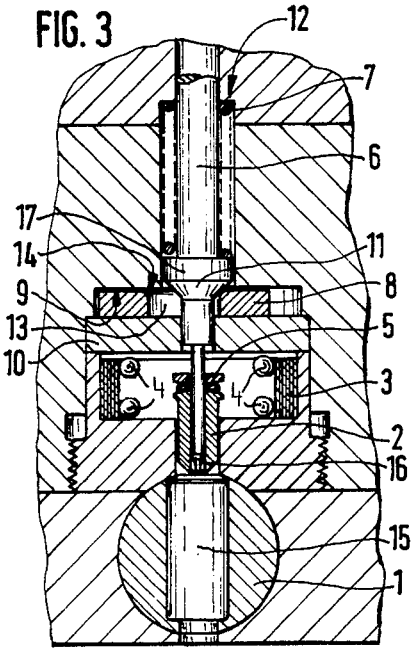
FIG. 3 shows the fuse according to FIG. 1, with the self-decomposition device in the live setting.
Figure 4:
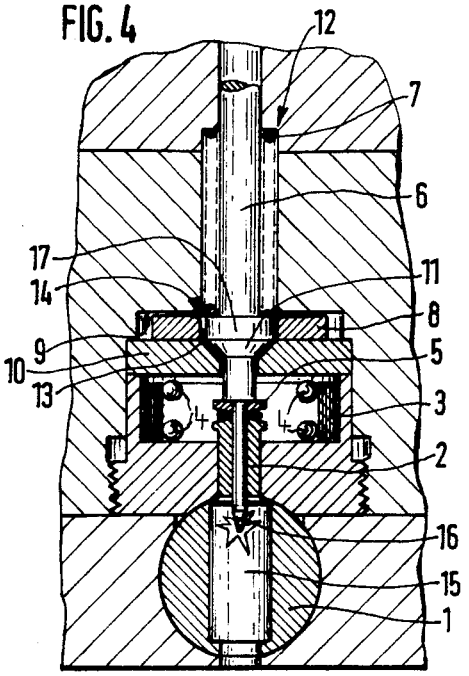
FIG. 4 shows the fuse according to FIG. 1 in the self-decomposition or impact setting.

Upon firing of the projectile, the spin of the housing H accelerates faster than the disk 8. This resultant relative rotation causes the disk to move in a generally elliptical pattern such that, the chamfer 14 of the bore 13 engages the conical surface 11 of the firing pin 6 (FIG. 2). The axial force component acting against the firing pin displaces the point of the firing pin 6, against the force of the firing pin spring 7, and out of the recess of the rotor 1. The unwinding of the wound strip 3 begins simultaneously, whereby the centrifugally-responsive bodies 4 are released (FIG. 3). The safety bush 2 is now axially mobile and is cammed out of the rotor recess by the walls of the latter to release the rotor 1 which is being rotated under the effect of the spin of the projectile. As a result, the rotor 1 turns until the centrifugal forces acting thereon are essentially equalized, i.e., until the percussion cap 15 is in the live setting (FIG. 3). In the meantime, the inertia disk 8 holds the firing pin 6 against the pressure of the firing pin spring 7 in ready position.

After a prescribed decline of the rate of projectile spin, the inertia disk 8 will be forced aside by the spring-biased firing pin and the point 16 of the firing pin 6 will be driven into the percussion cap 15 (FIG. 4) projectile.

If on the other hand, the projectile impacts before the inertia disk 8 has released th.e firing pin, the momentum of the firing pin compresses the spring 7 which then rebounds to cause the conical surface 11 of the firing pin to cam the inertia disk radially inwardly. The firing pin then immediately enters the percussion cap 15 to decompose the projectile.

Figure 5:
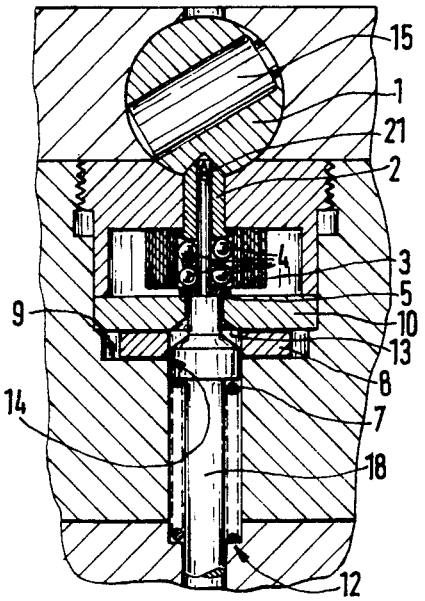
FIG. 5 shows a modified fuse used as a base fuse with a self-decomposing device.

In the case of a base-type fuse shown in FIG. 5, the tip of the firing pin faces toward, not away from, the tip of the fuse. Here again, the decomposing device according to the invention operates as described in relation to FIGS. 1–4. The difference between the configuration of the nose fuse and that of the base fuse involves the fact that in the base fuse the retreat of the firing pin 18 upon the firing of the projectile must be taken into account. For this reason, the cylindrical shoulder 17 of the firing pin is axially elongated in the base fuse so that in the safety position shown in FIG. 5, the shoulder 17 already projects into the center bore 13 of the inertia disk 8. Thus, when the firing pin recoils rearwardly (downwardly in FIG. 5) upon firing of the projectile, the conical surface 11 of the firing pin can still be engaged by the inertia disk 8 to hold the tip of the firing pin out of the recess of the rotor. The mode of operation of the base fuse as further described herein corresponds to that described in connection with the nose fuse of FIGS. 1–4. Because of structural requirements, it may be necessary to prevent the retreat of the firing pin 18 entirely or in part by means of a stop (now shown). In that case, the conical surface 20 does not protrude into the bore 13 of the inertia disk, so that the bore transition 14 immediately over-reaches the cone 20 of the firing pin 18 and raises the point 21 of the firing pin against the force of the firing pin spring 7 from the area of the rotor 1.

Figure 6:
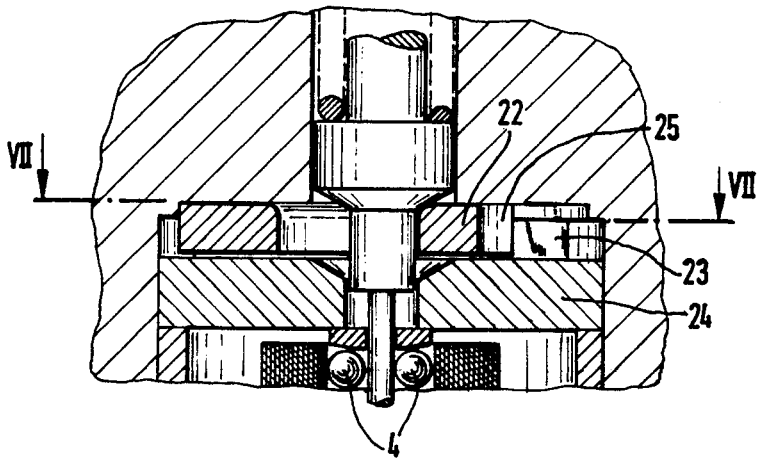
FIG. 6 shows a further modified fuse with an inertia disk in the form of a slide.
Figure 7:
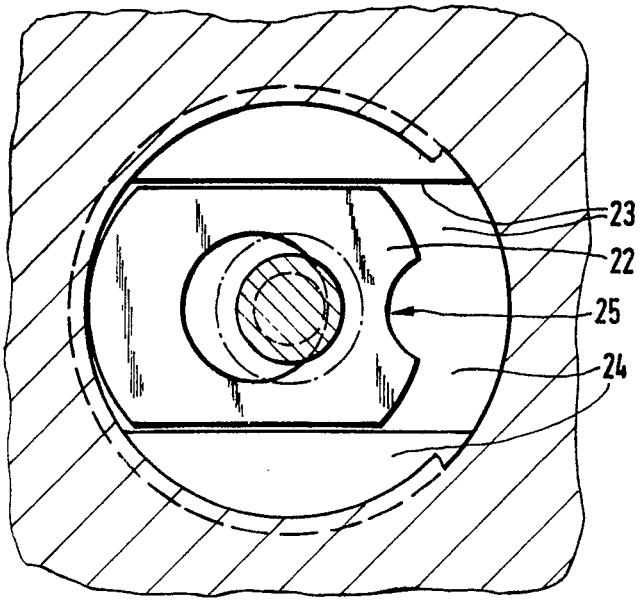
FIG. 7 shows the inertia disk according to FIG. 6 in a top view, taken along the line VII—VII in FIG. 6.

In FIGS. 6 and 7, the inertia disk is in the form of a slide 22, in order to effect a compensation for the unbalance of the fuse. The slide 22 is located in a groove 23 of the plate 24 arranged above the centrifugal body 4. The slide 22 fundamentally performs the same function as the inertia disk 8. Its movement under the effect of the spin is controlled merely by the groove 23. The mass of the slide 22 may be used further to compensate for an unbalance of the fuse or to reduce its weight. For this purpose, the slide 22 has a recess 25 on its outer circumference. In place of one recess, both the slide 22 and the inertia disk 8 may be provided with several recesses on their edges.

Although the present invention has been described in connection with preferred embodiments thereof, it will be appreciated by those skilled in the art that additions, modifications, substitutions, and deletions not specifically described, may be made without departing from the spirit and scope of the invention as defined in the appended claims.

What is claimed is:

1. A fuse for a spinning type projectile having percussion means, comprising:

a housing, a firing pin disposed in said housing for movement in the direction of its longitudinal axis, said firing pin comprising an ignition end projecting toward said percussion means, a conical surface disposed coaxially with said axis and widening in a direction away from said ignition end, said conical surface being spaced axially from said ignition end, and a cylindrical shoulder disposed adjacent the widened end of said conical surface and arranged concentrically relative to said axis, a spring yieldably urging said firing pin toward said percussion means, centrifugal means disposed in said housing and arranged to move radially relative to said firing pin, a winding band surrounding said centrifugal means for urging said centrifugal means radially inwardly to a position wherein said centrifugal means lies in a blocking relationship with a portion of said firing pin at a location between and spaced from said conical surface and said ignition end to block axial travel of said firing pin, said band being radially outwardly yieldable in response to centrifugal forces generated by the spinning of said projectile to enable said centrifugal means to be radially outwardly displaced by centrifugal forces out of blocking relationship with said firing pin, an inertia body mounted in said housing for movement in a radial direction relative to said firing pin, said inertia body being located at a position which is situated adjacent said conical surface when said centrifugal means is disposed in said blocking relationship with said firing pin, said inertia body including a throughbore through which said firing pin extends, said throughbore being sized to permit said firing pin to travel therethrough to reach said percussion means, said inertia body being displaceable radially in response to centrifugal forces generated during spinning of the projectile such that one end edge of said throughbore, which end edge is of blunt configuration, lies in the path of said conical surface to block axial travel of said firing pin to said percussion means against the force of said spring, the force of said spring being great enough to displace said inertia body radially out of its blocking relationship with said firing pin when the centrifugal forces are reduced to a predetermined strength.

2. A fuse according to claim 1 including a housing carrying said self-decomposing device, said wound strip, said centrifugally-responsive body, said firing pin, said inertia disk, and said percussion cap; said inertia disk being loosely disposed within a bore of said housing, the diameter of said bore being at least two times greater than the difference between the largest and smallest radii of said conical surface.

3. A fuse according to claim 1, wherein said cylindrical portion is arranged to extend into said bore of said inertia disk prior to being acted upon by axial forces from said inertia disk.

4. A fuse according to claim 1, wherein said inertia disk comprises a slide movable linearly within a linear groove located between said conical surface and said centrifugal body.

5. A fuse according to claim 1, wherein said inertia disk includes at least on substantially semicircular recess on its outer circumference.

6. A fuse according to claim 1, wherein said centrifugal means being arranged, when in said blocking relationship with said firing pin, to position said firing pin such that said cylindrical shoulder is located externally of said throughbore.

7. A fuse according to claim 1, wherein said inertia body comprises a disk-shaped weight disposed loosely within a bore of said housing, said housing bore having a diameter larger than a diameter of said weight by at least twice the amount corresponding to the difference between the largest and smallest radii of said conical surface.

8. A fuse according to claim 7, wherein said centrifugal means being arranged, when in said blocking relationship with said firing pin, to position said firing pin such that said cylindrical shoulder thereof projects into said throughbore of said inertia means.

9. A fuse according to claim 8, wherein said inertia means comprises an elongate-shaped slide, said housing including a plate upon which said slide is movably disposed, said plate including a groove in which said slide is confined to travel.

10. A fuse according to claim 9, wherein said slide includes an edge surface having a substantially semicircular recess therein disposed parallel to said throughbore.

* * * * *